United States Patent [19]

Watanabe

[11] 4,228,632

[45] Oct. 21, 1980

[54] COIN GUIDE CHUTE DEVICE FOR COIN PACKING MACHINE

[75] Inventor: Kenkichi Watanabe, Tokyo, Japan

[73] Assignee: Laurel Bank Machine Co., Ltd., Tokyo, Japan

[21] Appl. No.: 938,781

[22] Filed: Sep. 1, 1978

[30] Foreign Application Priority Data

Sep. 6, 1977 [JP] Japan ..... 52-107131

[51] Int. Cl.[2] ..... B65B 29/00

[52] U.S. Cl. ..... 53/54; 133/1 A; 221/2; 53/212

[58] Field of Search ..... 133/1 R, 1 A; 221/2; 193/DIG. 1, DIG. 2; 53/53, 54, 212

[56] References Cited

U.S. PATENT DOCUMENTS

| | | | |
|---|---|---|---|
| 4,026,089 | 5/1977 | Murakami et al. | 53/212 X |
| 4,040,434 | 8/1977 | Watanabe et al. | 133/1 A |

FOREIGN PATENT DOCUMENTS

| | | | |
|---|---|---|---|
| 221602 | 5/1959 | Australia | 133/1 A |
| 2425278 | 12/1974 | Fed. Rep. of Germany | 133/1 A |

*Primary Examiner*—Joseph J. Rolla

*Attorney, Agent, or Firm*—Fleit & Jacobson

[57] ABSTRACT

A coin guide chute device for use with a coin packaging machine winds packaging paper upon the circumferences of a preset number of accumulated coins and inwardly folds both ends of the wound paper, thereby preparing a package of coins. The coin guide chute device includes a guide chute which has a discharge opening so that the coin package may be guided therethrough to the outside, and a gate of an insulating material including an electrode portion which is hinged to the guide chute so as to close the discharge opening. The electric conduction between the guide chute and the electrode portion of the gate is detected through a loose coin, if any, thereby blocking the discharge opening by action of the gate.

2 Claims, 4 Drawing Figures

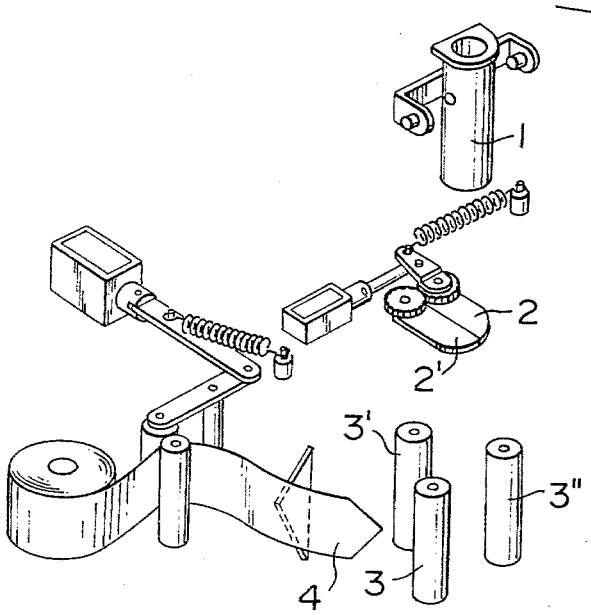
FIG. 1
FIG. 2
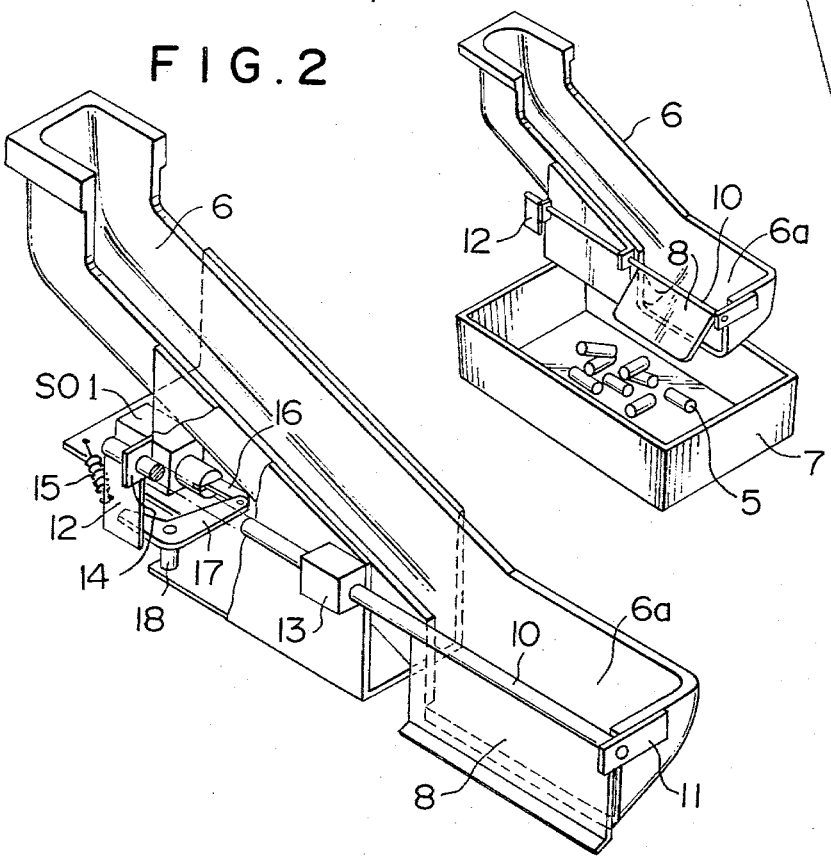

COIN GUIDE CHUTE DEVICE FOR COIN PACKING MACHINE

BACKGROUND OF THE INVENTION

1. Field of the Invention

The present invention relates to a coin packing machine for packing a preset number of coins in an accumulated shape, and more particularly to a coin guide chute device for use with the coin packing machine, by which a coin package is prevented from being made of a smaller number of coins, or by which the coin packing machine is prevented from continuing its operations under troubled conditions.

SUMMARY OF THE INVENTION

It is an object of the present invention to provide a coin guide chute device for use with a coin packing machine which is operative to count a preset number of coins and to pack the coins in an accumulated shape with packing paper, the device including a gate hinged to the discharge opening of a guide chute and insulated electrically from the guide chute so that the electric conduction therebetween may take place through a loose coin or coins acting as a conducting element only when the loose coin or coins is guided to fall down through the guide chute so as to reach the discharge opening, thereby informing an operator of the fact that a failure in the packing operations has taken place and that the coin or coins loosely falls down.

Another object of the present invention is to provide a coin guide chute device of the above type, which is made operative to keep the gate under its closed condition so that the loose coin or coins may be blocked by the gate from being discharged from the guide chute, and which is also made operative to stop the coin packing machine so that the abnormal coin package may be taken out in advance without being mixed with the normal ones already discharged.

A further object of the present invention is to provide a coin guide chute device of the above type, by which a package short of coins can be prevented from being handed to a customer.

According to a major aspect of the present invention, there is provided a coin guide chute device for use with a coin packing machine, comprising: a guide chute having a discharge opening for guiding a package of coins to the outside; a gate of an insulating material hinged to the discharge opening of said guide chute and biased to close said discharge opening; and control means for detecting electric conduction between said guide chute and said gate through a loose coin, if any, which is blocked at the discharge opening of said guide chute by the action of said gate.

BRIEF DESCRIPTION OF THE ACCOMPANYING DRAWINGS

In the drawings:

FIG. 1 is an exploded perspective view showing the major parts of a coin guide chute device of the present invention for accumulating, packing and discharging a preset number of coins;

FIG. 2 is an enlarged view showing the coin guide chute device of FIG. 1 especially in the vicinity of a gate;

DESCRIPTION OF THE PREFERRED EMBODIMENT

Figure 3:
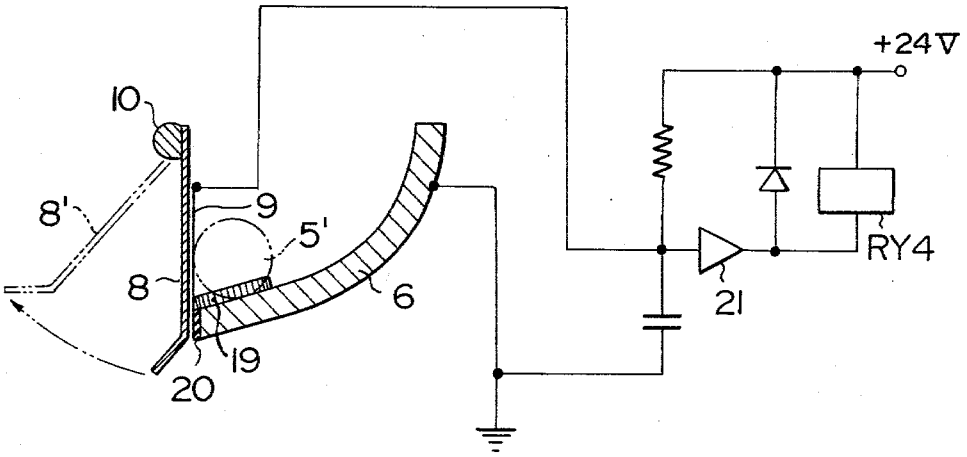
FIG. 3 is an illustrative presentation showing the relation between the section of the gate and an electric control circuit.

The present invention will now be described in connection with the embodiment thereof with reference to the accompanying drawings.

Reference is first made to FIG. 1, in which a coin guide chute device for a coin packing machine according to the present invention, especially its major parts, is shown in an exploded perspective view. When coins are counted and accumulated in a preset number within an accumulating cylinder 1, a pair of shutters 2 and 2' located below are opened to allow the accumulated coins as a whole to fall down into the space defined by the three packing rollers 3, 3' and 3'' of a packing mechanism which is located below the shutters 2 and 2'. As a result, the coins are supported on those three packing rollers 3, 3' and 3''. Then, packing paper 4 is unrolled and wound upon the circumferences of the accumulated coins such that its upper and lower ends approach inwardly to each other to fasten the coins, thereby to preparing a cylindrical package of coins 5. The coin package 5 thus prepared is then allowed to fall down into a guide chute 6 and further into a storage box 7 from the lower leading end portion **6*a* of the chute 6 so that it is stored in the box 7**. The construction of those parts of the coin guide chute device thus far described is similar to that of the prior art, and its detailed description is omitted.

Turning to FIG. 2, the essential construction of the present invention will be described in an enlarged scale. A gate 8 is attached to the guide chute 6 in a manner to face the discharge opening of the lower leading end portion **6*a*. The gate 8 is made of an insulating material, and a sheet electrode 9 is applied to or formed on the inner side of the gate 8, which is located to face the discharge opening of the guide chute 6, as better seen from FIG. 3. Moreover, the gate 8 is made to have its upper portion secured to a shaft 10 of rotation. This shaft 10 has its one end supported on a bracket 11 which is provided to protrude from the guide chute 6. To the other end of the shaft 10, there is secured an operating plate 12 which is biased at all times to close the gate 8 by the action of a coil spring 15. On the other hand, the shaft 10 is also constructed to have its extension supported rotatably at its midway by means of two bearings 13 and 14**.

As better seen from FIG. 2, an actuating lever 17 is supported rotatably on a pivot pin 18 and has its one end jointed to a link 16 which in turn is connected to a solenoid SO 1. The other end of the actuating lever 17 is located in abutment engagement with the operating plate 12. Thus, when the solenoid SO 1 is supplied with an electric power, it attracts and turns the actuating lever 17 so that the operating plate 12 may be turned up. As a result, the gate 8 is opened or released to the position, as shown at numeral 8' in FIG. 3, so that the coin package 5, which has been blocked for a while by the gate 8, is allowed to fall down for the purpose of storage.

Here, the guide chute 6 and the electrode 9 under normal conditions are electrically insulated from each other because an insulating member 20 is adhered to the surface of the lower leading end portion 6a of the guide chute 6. Moreover, the electrode 9 is connected with an amplifier 21, and the guide chute 6, itself acting as the other electrode, is grounded to the earth. As a result, if a loose coin or coins 19 is erroneously brought as a conductor into contact with those two electrodes 9 and 6, conduction takes place therebetween so that an electric current flows through a relay RY 4 which is connected to the output terminal of the amplifier 21. Thus, there is established a detecting circuit for detecting the loose coin or coins 19, as shown in FIG. 3.

Figure 4:
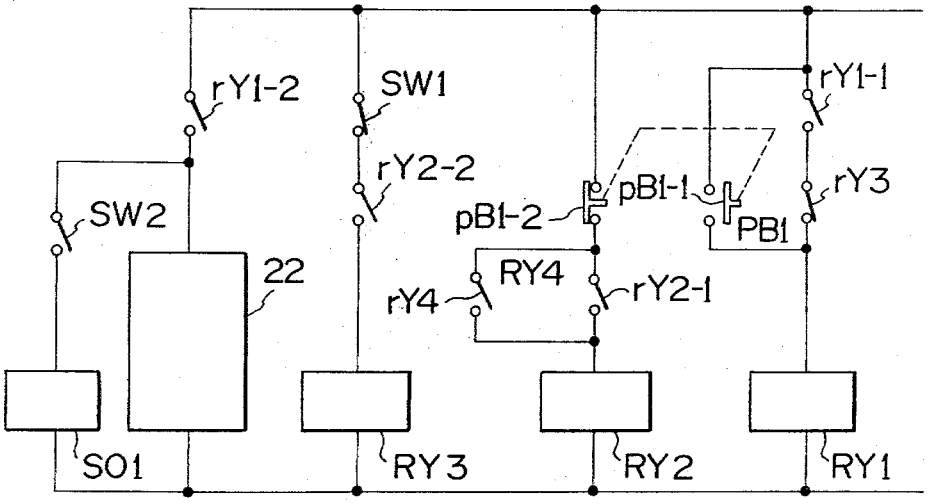
FIG. 4 is a block diagram showing the circuitry to be used with the coin guide chute device of the present invention.

Turning now to FIG. 4, more specifically, when the counting operation of a preset number of coins is finished, a start switch PB 1 begins to energize a first relay RY 1 so that the contact rY 1-1 of the latter is closed to constitute a self-maintaining circuit, thus starting the coin packing operations. In this instance, the start switch PB 1 has two contacts pB 1-1 and pB 1-2, the former being normally opened while the latter is normally closed. When the counting operation is finished, the start switch PB 1 is operated to have its contact pB 1-1 closed and the other pB 1-2 opened, but these two contacts instantly restore to their original positions after the first relay RY 1 has been brought into ite self-maintaining condition. On other hand, the other contact rY 1-2 of the first relay RY 1 is closed simultaneously with the contact rY 1-1 so that a package control circuit 22 is also operated. Then, the operation takes place at one-cycle stopping switch SW 1 to be controlled by a cam which is provided, although not shown, in a main cam line so as to mechanically control the one cycle of the packing operations, thus opening the contact of the switch SW 1. A gate opening control switch SW 2 to be controlled by another cam is then operated to have its contact closed. As a result, the gate opening control solenoid SO 1 is energized to operate to open the gate 8 so that the coin package 5 is allowed to fall down through that opening into the storage box 7. In this instance, the solenoid SO 1 is energized for a time corresponding to the width of an operating groove which is formed in the outer periphery of the cam, and the solenoid SO 1 is so energized that the gate 8 may be closed after it is opened for that time.

The coin packing machine continues its operations so that a preset number of accumulated coins are conveyed to its packing mechanism. In the meantime, the registration may become so deteriorated as to allow one or more upper coins to erroneously fall down in a loose manner or the packing operation of the paper 4 may become so deteriorated as to invite loose discharge of the coin or coins. In either case, the loose coin or coins 19 will fall down into the guide chute 6 and will slide on its inclined surface until the coin or coins arrive at their discharge opening. Since, however, this opening is closed by means of the gate 8, the coin or coins are blocked at that opening while contacting both the guide chute 6 and the gate 8. As a result, the coin or coins 19, acting as conductors, permit passage of the electric current therethrough so that the relay RY 4 is energized through the amplifier 21 to have its contact rY 4 closed. Then, a second relay RY 2 is operated to close its contact rY 2-1 so as to effect its self-maintaining condition. The other contact rY 2-2 of the relay RY 2 is simultaneously closed, but a third relay RY 3 is left deenergized because the one-cycle stopping switch SW 1 has its contact opened substantially simultaneously as the operations are started. As a result, the packing operations are continued as they are, so that the coins are packed. When, therefore, the one-cycle stopping cam of the main cam line is returned to its original position after coin package is discharged into the guide chute 6 after their packing operations, the one-cycle stopping switch SW 1 comes into engagement with the operating groove of that cam until its contact is closed. As a result, the relay RY 3 is energized to open its contact rY 3 so that the self-maintaining circuit of the relay RY 1 is released. Thus, the coin packing machine is stopped at its original position.

On the other hand, the coin package 5' discharged is allowed to slide down on the guide chute 6 but is blocked by the gate 8 so as to stop in a similar manner to the case of the coin or coins 19. Therefore, the operator is informed of the fact that the number of coins in the package 5' is smaller than a preset number. Then, he can easily discriminate the package 5', from the normal one 5 so that he can remove the abnormal one 5' together with the loose coin or coins 19 without any difficulty.

Although the foregoing description is directed to the method, in which both the abnormal coin package and the loose coin or coins are removed manually by the operator himself, the coin guide chute device may desirably be so modified that they can be removed to another storage box by providing another gate which is responsive to the abnormal detecting signals.

Conversely, in the case that the packing operations are accomplished in a normal manner, the normal coin package 5 is once prevented from falling down into the storage box 7 by the action of the gate 8 but can be stored in an orderly manner in the box 7 because the gate 7 is opened during the next packing cycle. Moreover, although the coin package 5 also comes into contact with both the guide chute 6 and the gate 8 when it is blocked by the latter, no electric conduction takes place because it is covered with the packing paper acting as an insulating material. As a result, the continuous packing operations can be ensured.

As has been described hereinbefore, it should be appreciated, as an advantage of the present invention, that the coin guide chute device of the invention can reliably eliminate the troubles which might otherwise be met by such a conventional coin packing machine which has no monitor in the course of the handling of the coins from the step of taking the accumulated coins out of the accumulating cylinder to convey them to the packing mechanism to the step of finishing the packing operations. With this in mind, the coin guide chute device of the present invention can enjoy its remarkable effects in the case where it is used as a coin control mechanism requiring especially correct counts.

What is claimed is:

1. In a coin packaging machine including means for winding packaging paper upon the circumferences of a preset number of accumulated coins, and fastening means for folding inwardly both ends of the wound packaging paper to fasten the same, whereby to prepare a coin package;

a coin guide chute device comprising:

guide chute means including a discharge opening for guiding the coin package from the coin packaging means, said guide chute means including an electrically conductive portion, gate means of an insulating material hinged to the discharge opening of said guide chute means and biased for closing said discharge opening so as to block said coin package guided thereto, said gate means including an electrode portion; and control means for detecting electric conduction between said guide chute means and said electrode portion of said gate means when a loose coin is blocked at the discharge opening of said guide chute means by said gate means.

2. In the coin packaging machine of claim 1, wherein a loose coin is detected in a given cycle, said coin guide chute device further comprising:

means for opening the discharge opening of said guide chute means during a preset period in each cycle; and means for maintaining said discharge opening closed in a cycle subsequent to the given cycle in which said loose coin is detected.

* * * * *